US008511427B2

(12) United States Patent
Dittmar et al.

(10) Patent No.: US 8,511,427 B2
(45) Date of Patent: Aug. 20, 2013

(54) BLOWER ARRANGEMENT

(75) Inventors: Rudi Dittmar, Schmalkaden (DE); Peter Fischer, Bad Neustadt (DE)

(73) Assignee: Gardner Denver Deutschland GmbH, Bad Neustadt (DE)

( * ) Notice: Subject to any disclaimer, the term of this patent is extended or adjusted under 35 U.S.C. 154(b) by 0 days.

(21) Appl. No.: 13/291,597

(22) Filed: Nov. 8, 2011

(65) Prior Publication Data

US 2012/0132479 A1 May 31, 2012

(30) Foreign Application Priority Data

Nov. 25, 2010 (DE) ..... 10 2010 061 994

(51) Int. Cl.
*F01N 13/00* (2010.01)

(52) U.S. Cl.
USPC ..... 181/225; 181/228; 181/258; 181/250; 181/227; 181/212

(58) Field of Classification Search
USPC ..... 181/258, 225, 250, 227, 228, 212, 181/247
See application file for complete search history.

(56) References Cited

U.S. PATENT DOCUMENTS

| | | | | |
|---|---|---|---|---|
| 1,975,861 | A | 10/1934 | Oldberg | |
| 3,955,643 | A | 5/1976 | Clark | |
| 4,316,523 | A * | 2/1982 | Boretti | 181/226 |
| 5,020,631 | A | 6/1991 | DeVille | |
| 5,162,622 | A * | 11/1992 | Malmsten | 181/227 |
| 5,841,080 | A * | 11/1998 | Iida et al. | 181/225 |
| 5,901,754 | A * | 5/1999 | Elsasser et al. | 138/118 |
| 6,158,082 | A * | 12/2000 | Beckey et al. | 15/326 |
| 6,991,043 | B1 * | 1/2006 | Chen | 173/169 |
| 7,367,424 | B2 * | 5/2008 | Brown et al. | 181/250 |
| 7,806,649 | B2 | 10/2010 | Ishikawa et al. | |
| 7,942,234 | B2 * | 5/2011 | Utsunomiya | 181/225 |
| 2010/0193282 | A1 | 8/2010 | Kim et al. | |

FOREIGN PATENT DOCUMENTS

| | | |
|---|---|---|
| AT | 124595 | 9/1931 |
| AU | 541617 B2 | 3/1980 |
| CA | 1197193 | 2/1984 |
| DE | 1292669 B | 4/1969 |

(Continued)

OTHER PUBLICATIONS

Office Action related to DE 10 2010 061 994.9.

(Continued)

*Primary Examiner* — Forrest M Phillips
(74) *Attorney, Agent, or Firm* — James B. Conte; Husch Blackwell LLP

(57) ABSTRACT

The invention relates to a blower arrangement for gas. The blower arrangement comprises a blower with a blower housing, at least one gas-inlet opening formed in the blower housing and gas-outlet opening, and at least one rotary-driven blower wheel arranged in the blower housing. Furthermore, the blower arrangement has at least one silencer device with at least one gas guiding element, wherein the gas-guiding element comprises a plurality of silencer openings and is designed as a gas guiding pipe. The gas guiding pipe varies its cross section along its longitudinal extension and has a wall, which is designed to be wave-like along the longitudinal extension of the gas guiding pipe. The silencer device also comprises at least one silencer chamber, which is in flow connection with the silencer openings and is arranged at least in sections laterally behind the gas guiding element.

9 Claims, 9 Drawing Sheets

(56) References Cited

FOREIGN PATENT DOCUMENTS

| | | | |
|---|---|---|---|
| DE | 196 49 529 | A1 | 4/1998 |
| DE | 102004048481 | B3 | 5/2004 |
| DE | 10 2004 048 481 | B3 | 9/2006 |
| EP | 1507071 | A1 | 11/2004 |
| GB | 417935 | | 4/1933 |
| GB | 610000 | A | 3/1946 |
| GB | 1072799 | | 10/1964 |
| JP | 4124495 | | 4/1995 |
| JP | 05065896 | A | 5/2004 |
| RU | 2051295 | C1 | 12/1995 |
| SU | 549598 | A | 4/1977 |
| WO | WO97/10440 | | 3/1997 |

OTHER PUBLICATIONS

Summary of an Office Action relating to German companion case DE 10 2010 061 994.9 and the foreign references cited therein.
Search report related to Great Britain patent application GB1119938.7.
EPO Machine Translation of Description and claims of EP1507071.
EPO Machine Translation of Description and claims of DE102004048481.
EPO Machine Translation of Description and claims of WO9710440.
Search report for Eurasian companion case 201171209.
Summary for Russian case RU 2051295.
Summary for Soviet Union case SU549598.
Abstract for JP 4124495.

* cited by examiner

BLOWER ARRANGEMENT

FIELD

The invention relates to a blower arrangement for gas, in particular a side channel blower arrangement.

BACKGROUND

Blowers are generally known from the prior art. They are used in general for conveying gases, where the gases are also compressed during the conveying. The operation of the blower is often associated with a significant level of noise. In general to reduce the operating noise levels absorption silencers with filler materials are used. Foam, mineral wool and/or metal wool can be used as the filler materials. Said known absorption silencers can only be used in blowers which are used for conveying chemically safe gases, such as for example air.

Furthermore, the prior art discloses blower arrangements with Helmholtz resonators, which dampen the tonal sound components. Said blower arrangements are extremely expensive to produce.

SUMMARY

According to one embodiment disclosed herein at least one silencer device comprises at least one gas conveying element comprising a plurality of silencer openings for guiding gas and at least one silencer chamber, which is arranged at least in sections laterally behind the at least one gas guiding element.

Gas in the silencer openings in the at least one gas guiding element interacts during the operation of the blower with the gas volume in the at least one silencer chamber as an acoustic mass spring system, which leads to an extremely high degree of noise reduction.

By having suitable dimensions for the silencer openings also laminar, acoustic frictional effects occur in the silencer openings which further improve the sound reduction.

The brief increase of sound pressure in a gas flow channel delimited by the at least one gas guiding element causes a time-delayed inflow of gas into the at least one laterally adjacent silencer chamber. With the following pressure reduction in the gas flow channel the volume of gas in the silencer chamber expands back into the gas guiding channel. This results in pressure equalization or partial wave compensation with partial sound cancellation.

The at least one silencer device is free of filler materials, so that the blower arrangement is also suitable for conveying chemically critical gases, for conveying oxygen and/or ozone. It can thus also be produced very inexpensively.

The at least one gas guiding element can be made from a metal material. It can be made from a stretched metal, a metal weave, a metal fabric or a perforated metal sheet. However, it can also be made from glass fabric modifications or sintered materials.

It is an advantage if the silencer openings are micro-openings. Preferably, the silencer openings have an opening width, which is between 0.05 mm and 1 mm, more preferably between 0.1 mm and 0.4 mm. Advantageously, the ratio between the opening area of the silencer openings and the total area of the gas guiding element is between 0.05% and 10%, more preferably between 1% and 5%. Preferably, the silencer openings have an elongated form respectively, for example an elongated rectangular form, the longitudinal sides of which are aligned to be perpendicular to the main flow direction of a gas flowing past or to the extension of the gas guiding element.

It is also advantageous if the thickness of the gas guiding element is between 0.1 mm and 1 mm, more preferably between 0.3 mm and 0.7 mm.

The gas guiding element designed as a gas guiding pipe can be produced extremely inexpensively and easily. It also enables a particularly high degree of sound reduction. It is an advantage if the gas guiding element has a circular ring-shaped cross section.

Optimal values for the acoustic flow resistance are in this case:

W (pressure loss via the wall of the gas guiding pipe/gas speed perpendicular to the gas guiding pipe (measured in front of the gas guiding pipe))=Dp/(0.05 m/s)=500 to 1500 Pa s/m, wherein the value "0.05 m/s" is the reference speed; and a pressure loss coefficient (=2*pressure loss via the wall of the gas guiding pipe/(gas density*square of the gas speed (perpendicular) in front of the gas guiding pipe)= 3000 to 7000

The gas guiding pipe changes its cross section along its longitudinal extension. The gas guiding pipe changes its cross section alternately. For this purpose the gas guiding pipe has wave troughs and wave peaks, which alternate with one another.

A particularly good level of sound reduction is possible as a function of the frequency range to be damped. The spacings e of the screen walls from one another are preferably selected as a function of the frequency range to be damped. The preferred spacing e can be calculated by the following formula:

$$e=42500/f$$

The spacing e is in mm, whereas the frequency range f to be damped is measured in Hz. The spacing e of the screen walls from one another can also be regular.

The screen walls have an irregular or uneven spacing from one another. Preferably, in this case there are no or hardly any repetitions of the selected spacings. In this way periodic developments of noise can be avoided particularly well.

A closed, preferably separate silencer device can be provided. The spacing between the gas guiding element and the silencer housing determines to a significant degree the effective frequency range of the noise reduction. Larger spacings cause a displacement of the start of the damping up to lower frequencies. Advantageous damping ratios are produced in the frequency range between 800 Hz and 4000 Hz for spacings which are between 5 mm and 35 mm, preferably between 10 mm and 25 mm. With the indicated spacings in the frequency range between 800 Hz and 4000 Hz extremely high levels of sound absorption are achieved.

The gas guiding element can be arranged in the blower housing. It can be provided in addition to or alternatively to the silencer device connected to the gas outlet opening. It is an advantage if said gas guiding element is designed as a separating wall.

DETAILED DESCRIPTION

Figure 1:
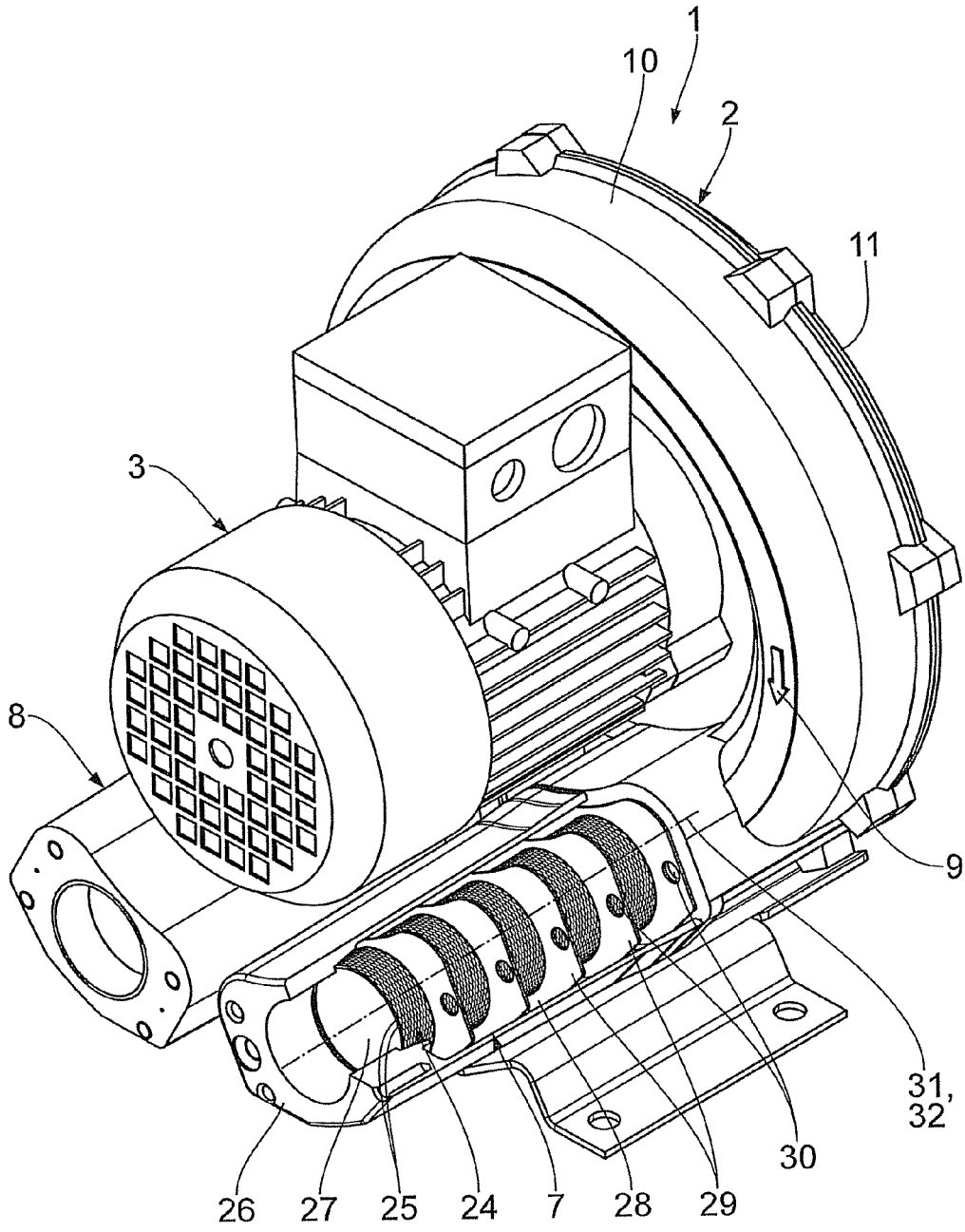
FIG. 1 shows a perspective view of a blower arrangement comprising a blower and a partially cut-away, first silencer device.
Figure 3:
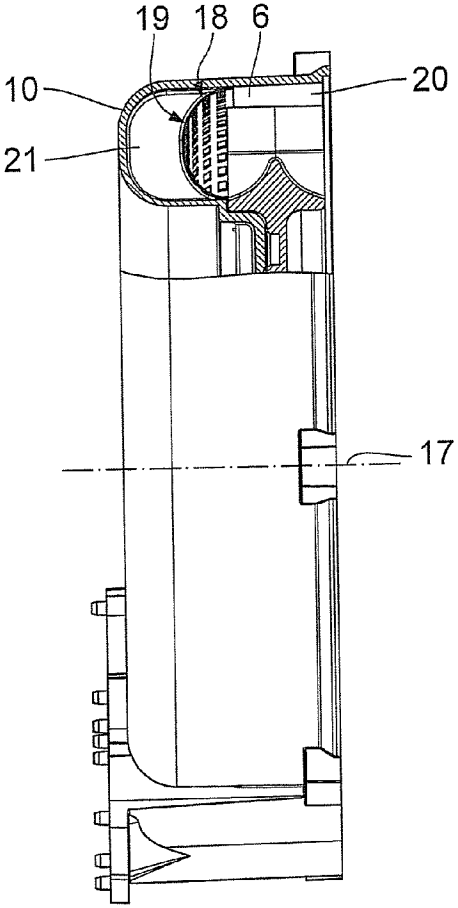
FIG. 3 shows a cross section of the blower shown in FIG. 2.
Figure 2:
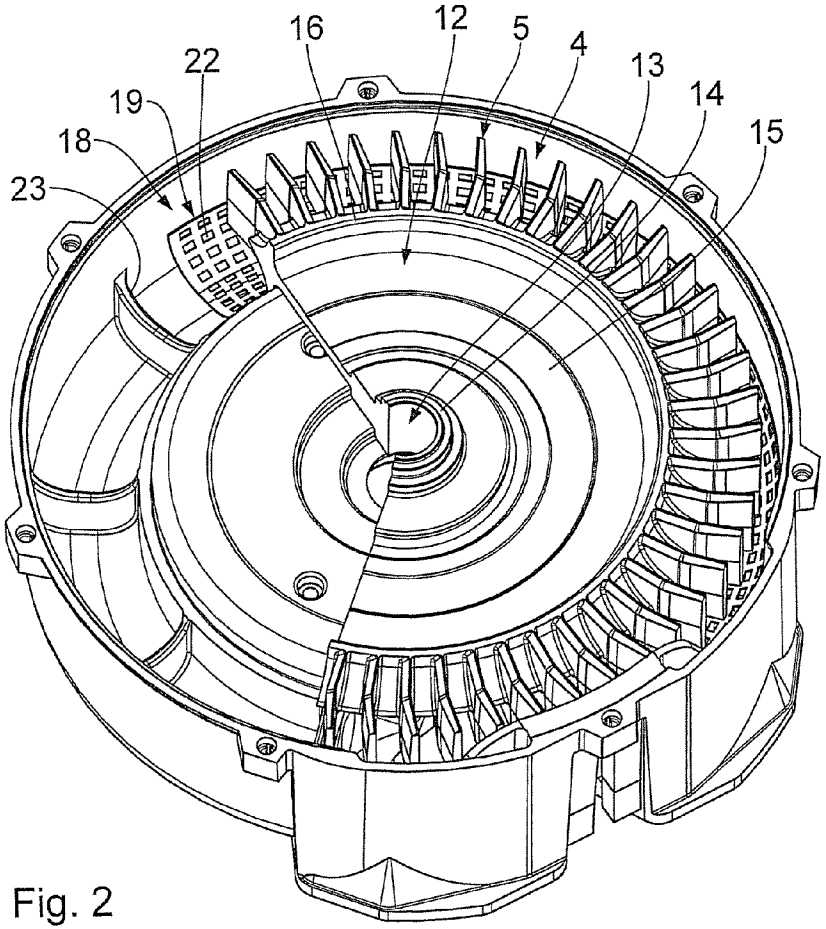
FIG. 2 shows a perspective view of the blower shown in FIG. 1 with a removed housing lid.

A blower arrangement shown in full in FIG. 1 comprises a blower 1 with a blower housing 2 and a drive motor 3, which is flange-mounted onto the end face of the blower housing 2. The blower 1 also has a blower wheel 4 arranged in the blower housing 2, which blower wheel is shown in FIGS. 2 and 3 and comprises a plurality of blower wheel blades 5. The blower wheel 4 is rotary driven by the drive motor 3. The blower wheel blades 5 are located in a gas channel 6 delimited at least partly by the blower housing 2.

In the blower housing 2 a gas inlet opening (not shown) and a gas outlet opening (not shown) are provided, which are in flow connection with the gas channel 6. A first silencer device 7 connects to the gas outlet opening, whereas upstream of the gas inlet opening a conventional feed pipe 8 is arranged.

The blower 1 is designed as a side channel blower, so that the gas channel 6 is a side channel.

During the operation of the blower 1 the blower wheel 4 is rotated by the drive motor 3 in the direction of the arrow 9. The blower wheel blades 5 sweeping past the gas inlet opening suction the gas to be conveyed via the feed pipe 8 and the inlet opening into the gas channel 6. The blower wheel blades 5 accelerate the gas located in the gas channel 6 in the direction of the arrow 9, which can thus also be denoted as a transport arrow. The gas is in this case enclosed in cells, which are delimited by adjacent blower wheel blades 5. At the end of the revolution the gas wheel blades 5 push the gas via the gas outlet opening out of the gas channel 6 into the first silencer device 7. An interrupter (not shown) prevents the gas transported by the blower wheel 4 from being transported inside the gas channel 6 from the gas outlet opening further to the gas inlet opening. The first silencer device 7 dampens the noise of the gas exiting out of the gas outlet opening.

The blower housing 2 comprises a housing body 10 and a housing lid 11, which together enclose the blower wheel 4. The drive motor 3 is flange connected onto the rear side of the housing body 10. It comprises a rotary-driven drive motor shaft (not shown), which is in rotational connection with the blower wheel 4.

The blower wheel 4 is designed to be disc-like. It comprises an inner blower wheel hub 12 with a central, circular, hub bore 13. The blower wheel hub 12 is formed by an inner hub foot 14 delimiting radially outwardly the hub bore 13 and a circular ring-shaped hub disc 15 connecting radially therewith. Furthermore, the blower wheel 4 comprises a radially outer support ring 16, which connects externally with the hub disc 15 and overlaps the latter laterally. The support ring 16 supports a plurality of blower wheel blades 5 distributed in circumferential direction, which project radially. The blower wheel blades 5 have an angular spacing from one another.

The central hub bore 13 is used for mounting the drive motor shaft. For transferring a torque from the drive motor shaft to the blower wheel hub 12 for the rotation of the blower wheel 4 about a longitudinal middle axis 17 a conventional key connection is provided between the drive motor shaft and the hub foot 14.

The gas channel 6 extends ring-like around the longitudinal middle axis 17. It is delimited laterally by the housing body 10 and the housing lid 11. In the gas channel 6 a second silencer device 18 is provided. The second silencer device 18 comprises a gas guiding element 19, which divides the gas channel 6 into a gas flow channel 20 and silencer chambers 21. The blower wheel blades 5 are located in the gas flow channel 20. The gas flow channel 20 runs adjacent to the housing lid 11, whereas the silencer chambers 21 are located laterally adjacent or behind the gas flow channel 20. The gas flow channel 20 is delimited by the housing lid 11, the gas guiding element 19 and radially outwards by the housing body 10. The gas guiding element 19 is thus opposite the housing lid 11.

The gas guiding element 19 thus forms in the gas channel 6 a separating wall and runs ring-like around the longitudinal middle axis 17. It is designed to be curved in a circular arc shape in cross section. It runs from its edges to its central area away from the housing lid 11.

In the gas guiding element 19 a plurality of silencer openings 22 are arranged, which produce a flow connection between the gas flow channel 20 and the silencer chambers 21. The silencer chambers 21 are separated from one another by screen walls 23, which are arranged behind one another in the main flow direction of the gas in the gas flow channel 20. The silencer chambers 21 are also arranged behind one another in the main flow direction of the gas in the gas flow channel 20. The screen walls 23 are in direct connection with the housing body 10 and run essentially in radial direction.

The first silencer device 7 comprises a gas guiding element 24, which is tubular and is designed to be circular ring shaped in cross section. The gas exiting from the gas outlet opening flows axially through the gas guiding element 24. The gas guiding element 24 has in its wall a plurality of lateral silencer openings 25. It is arranged in a silencer housing 26 and delimits outwardly a gas flow channel 27, which is in flow connection via the silencer openings 25 with silencer chambers 28. The silencer chambers 28 are delimited externally by the silencer housing 26 and are arranged laterally behind the gas flow channel 27. They are designed to be circular ring-shaped in cross section.

The silencer chambers 28 are separated from one another by screen walls 29, which run essentially parallel to one another and have an identical spacing from one another. The silencer chambers 28 are arranged behind one another in the main flow direction of the gas in the gas guiding element 24. They are delimited by two adjacent screen walls 29, the gas guiding element 24 and the silencer housing 26. The silencer chambers 28 are arranged in the direction of the longitudinal middle axis 17 laterally behind the gas flow channel 20.

The gas guiding element 24 is arranged concentrically in the silencer housing 26. It has a longitudinal middle axis 31, which coincides with the longitudinal middle axis 32 of the silencer housing 26. The silencer chambers 28 are arranged perpendicular to the longitudinal middle axis 31 laterally behind the gas guiding element 24.

During the operation of the blower 1 the gas flows mainly along the gas flow channel 20 in the direction of the arrow 9. The gas passes in the gas flow channel 20 through the individual silencer chambers 21, which are arranged behind one another in the main flow direction of the gas in the gas flow channel 20. A portion of the gas flows perpendicular to the main flow direction of the gas and pushes through the silencer openings 22 in the gas guiding element 19, so that it reaches the corresponding chambers 21 arranged laterally behind the gas flow channel 20. Said gas can then flow through the silencer openings 22 of the respective silencer chambers 21 back into the gas flow channel 20.

The gas coming out of the gas outlet opening enters into the gas flow channel 27 via its inlet opening and passes therein mainly through the individual silencer chambers 28, which are arranged behind one another in the main flow direction of the gas or in the direction of the longitudinal middle axis 31. A portion of the gas flows perpendicular to the main flow direction of the gas and passes via the silencer openings 25 into the silencer chambers 28 arranged laterally behind the gas flow channel 27. Said gas can flow from the corresponding silencer chambers 28 via the silencer openings 25 back into the gas flow channel 27. The gas leaves the gas flow channel 27 via its outlet opening which is opposite the inlet opening. Screw openings 30 are shown in the screen walls 29.

Figure 4:
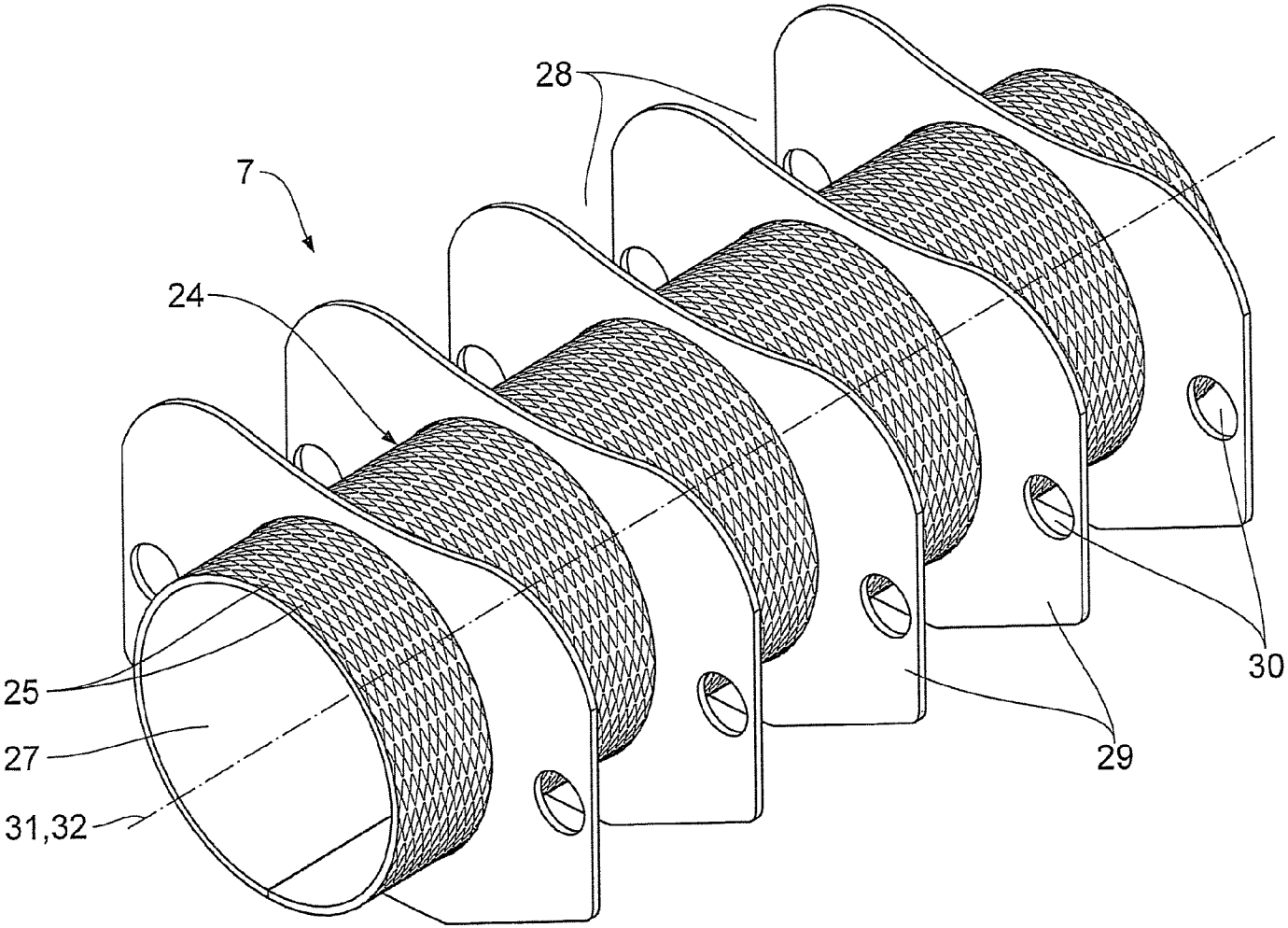
FIG. 4 shows a perspective view of the first silencer device shown partly cut-away in FIG. 1.
Figure 5:
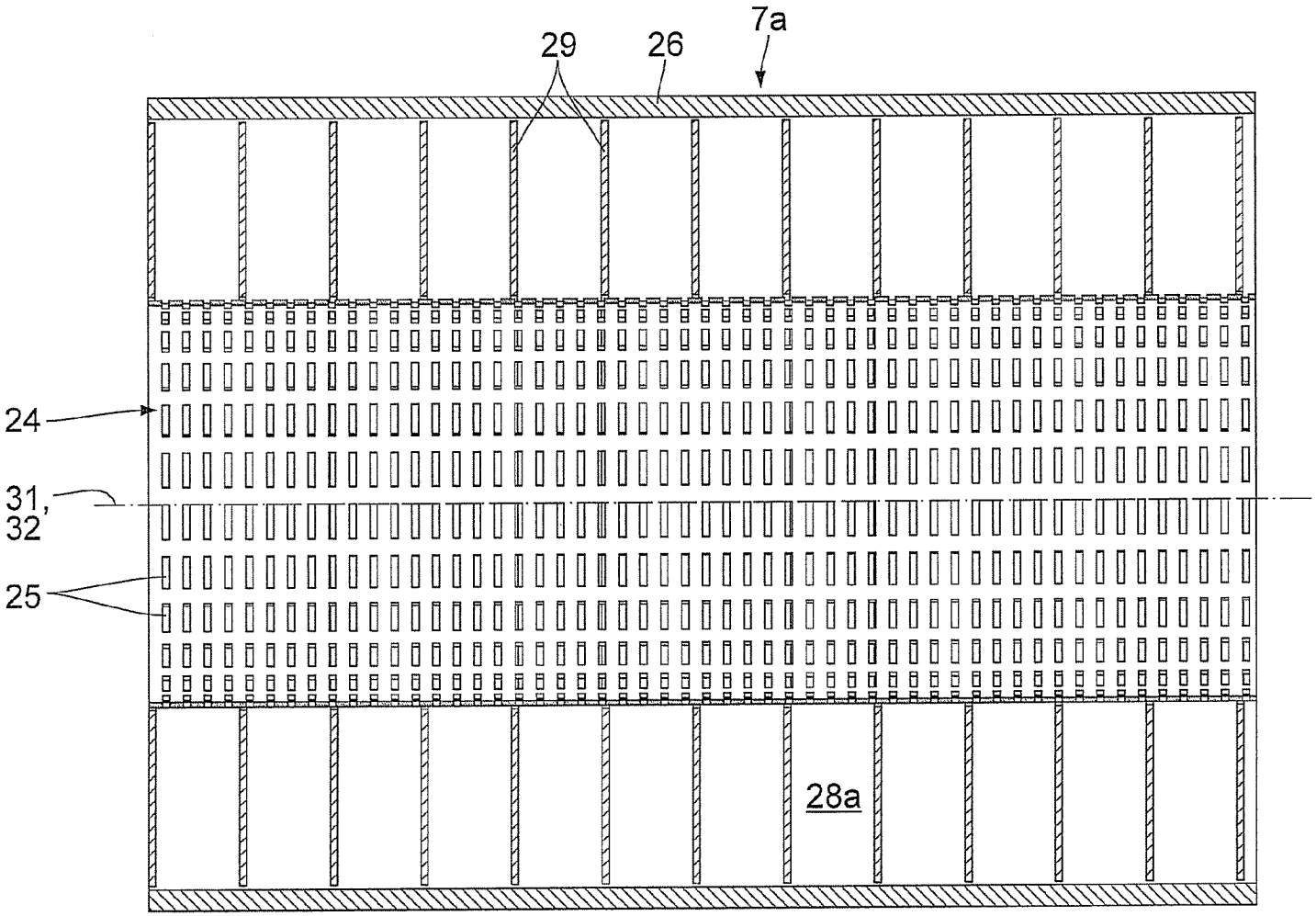
FIG. 5 shows a longitudinal cross section of a first sound silencer device according to a second embodiment.

In the following with reference to FIG. 5 a second preferred embodiment of a first silencer device is described, which is assigned the reference number 7*a*. Identical components have been given the same reference numbers as in the first embodiment, which is referred to here. Structurally different, but functionally similar components have been given the same references numbers with an additional "a". Compared with the first silencer device 7 according to FIGS. 1 and 4 the silencer device 7*a* according to FIG. 5 has a higher, preferably a much higher, number of screen walls 29 with the same axial length of the silencer devices 7, 7*a*. The screen walls 29 thus have a smaller spacing in the direction of the longitudinal middle axis 31 or 32 to one another than in the first embodiment, which results in correspondingly axially shorter silencer chambers 28*a*. The spacing of the screen walls 29 from one another is constant again.

Figure 6:
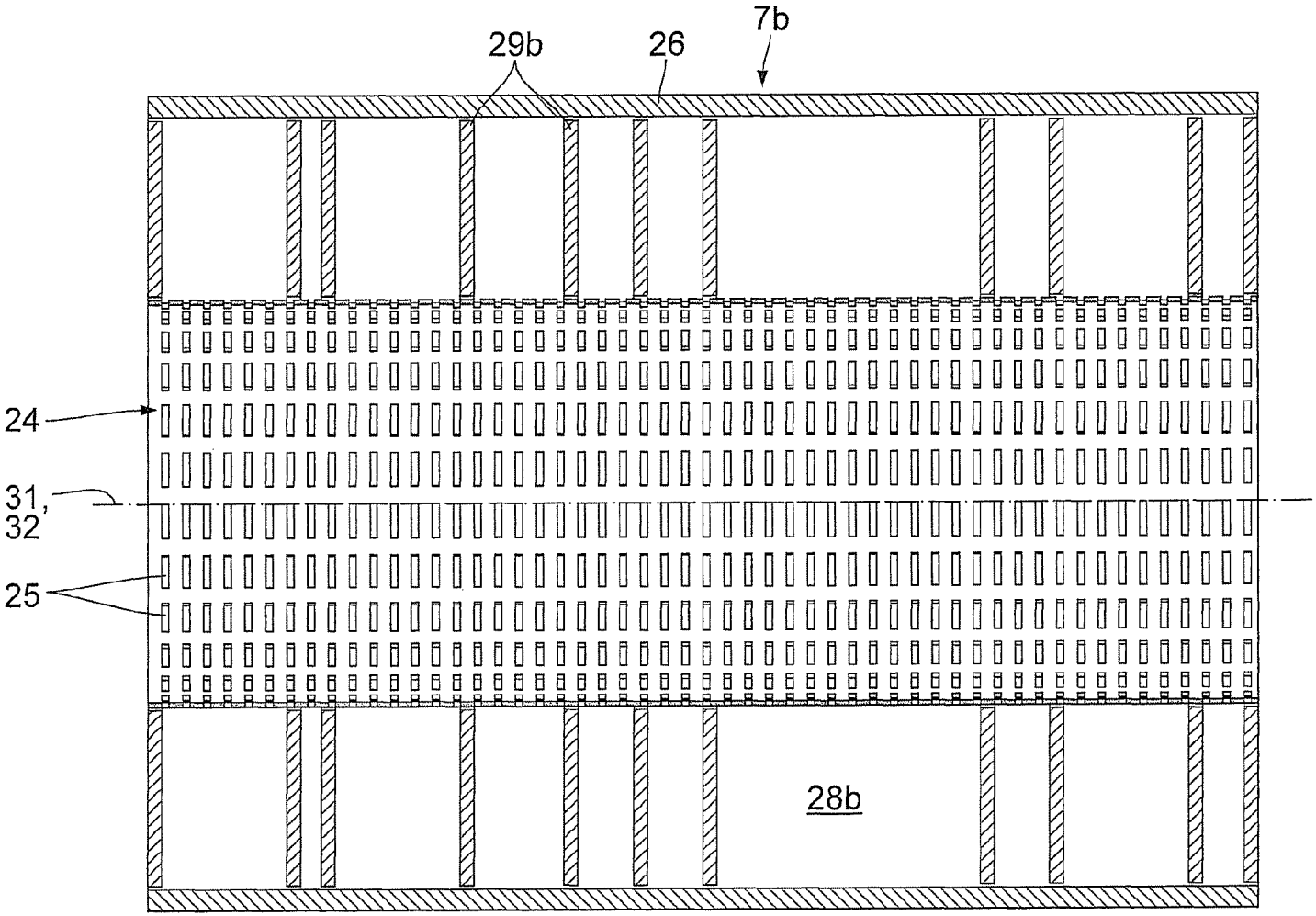
FIG. 6 shows a longitudinal cross section of a first silencer device according to a third embodiment.

In the following with reference to FIG. 6 a third embodiment of a silencer device is described, which has the reference number "7*b*". Compared to the silencer device 7 shown in FIGS. 1 and 4 here the screen walls 29 have an irregular or uneven spacing apart from one another in the direction of the longitudinal middle axis 31 or 32. The silencer chambers 28*b* thus have different lengths in the direction of the longitudinal middle axis 31 or 32. A silencer chamber 28*b* can have an axial length, which corresponds to a multiple of the axial length of a different silencer chamber 28*b*.

Figure 7:
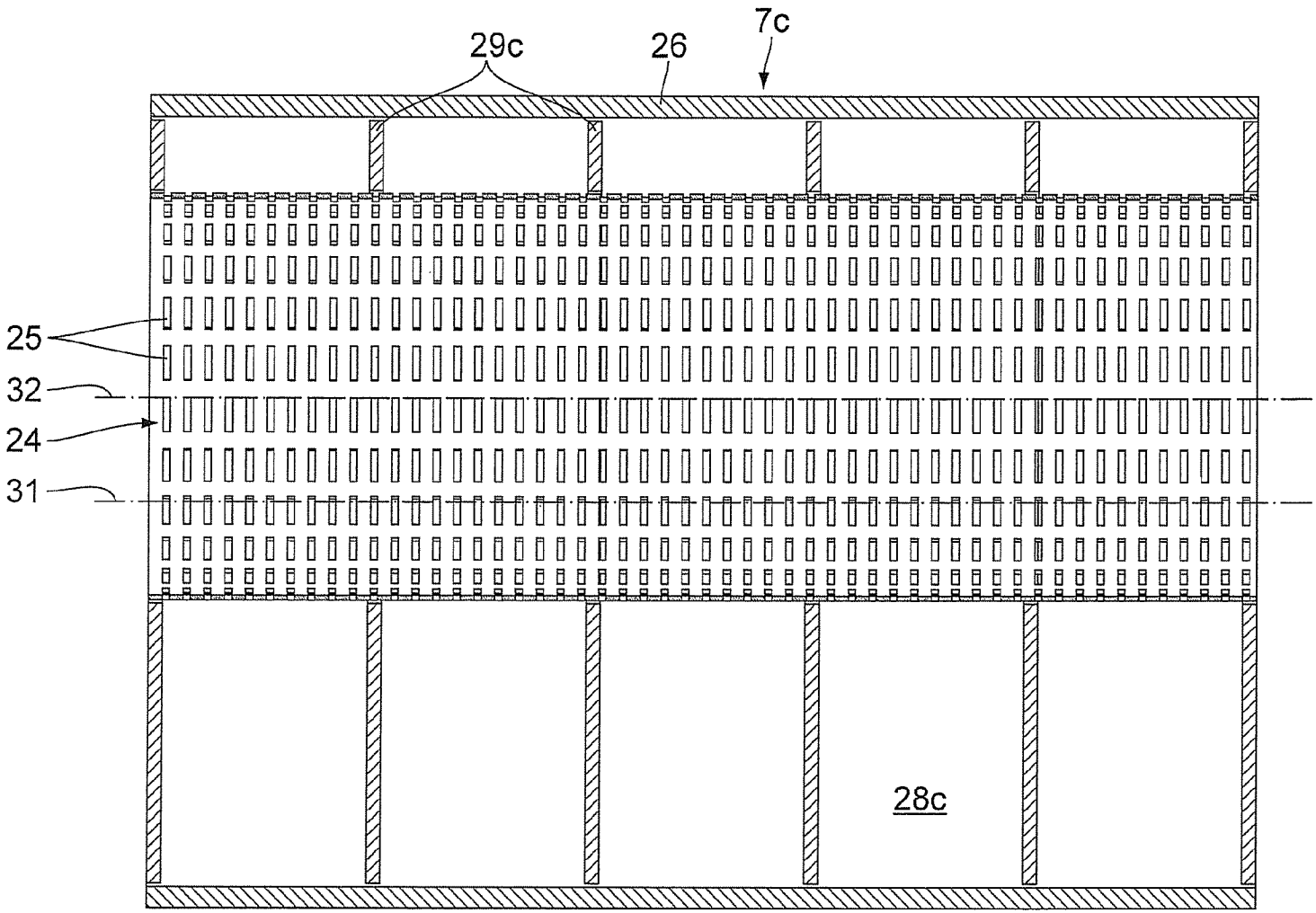
FIG. 7 shows a longitudinal cross section of a first silencer device according to a fourth embodiment.

In the following with reference to FIG. 7 a fourth embodiment of a silencer device is described which has been assigned the reference number "7*c*". The silencer device 7*c* differs from the silencer device 7 according to the first embodiment in that the gas guiding element 24 is arranged eccentrically in the silencer housing 26. The longitudinal middle axis 31 of the gas guiding element 24 thus does not coincide with the longitudinal middle axis 32 of the silencer housing 26. The gas guiding element 24 is designed to be tubular again.

Figure 8:
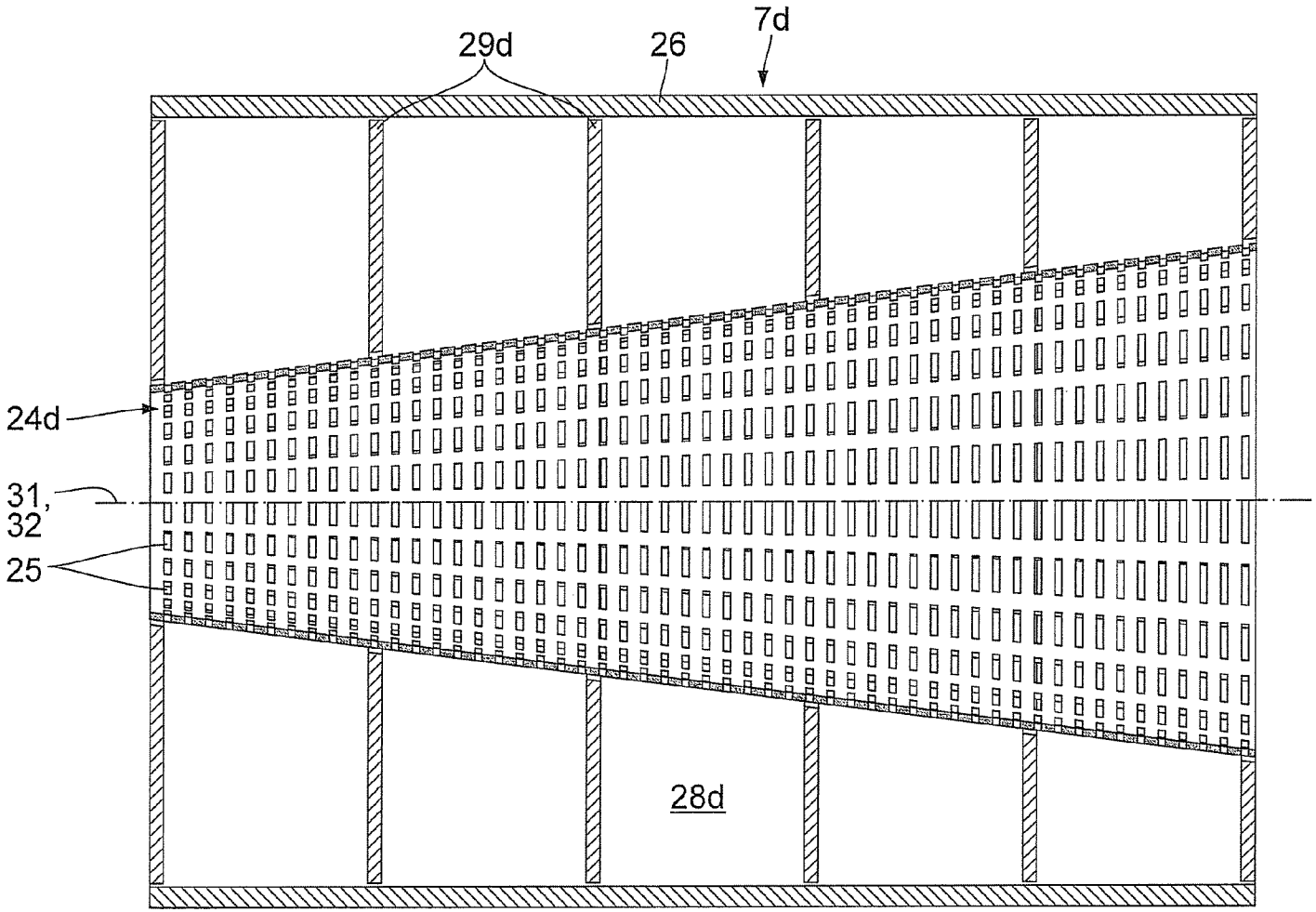
FIG. 8 shows a longitudinal cross section of a first silencer device according to a fifth embodiment.

In the following with reference to FIG. 8 a fifth embodiment of a silencer device is described, which has been given the reference number "7*d*". The silencer device 7*d* has a tubular gas guiding element 24*d*, which is designed in the form of a hollow truncated cone. The cross sectional area of the gas guiding element 24*d* changes continually. The cross sectional area at a first end of the gas guiding element 24*d* can be a multiple of the cross sectional area on the second opposite end. It can change for example by a factor which is between 2 and 10, preferably between 4 and 8.

Figure 9:
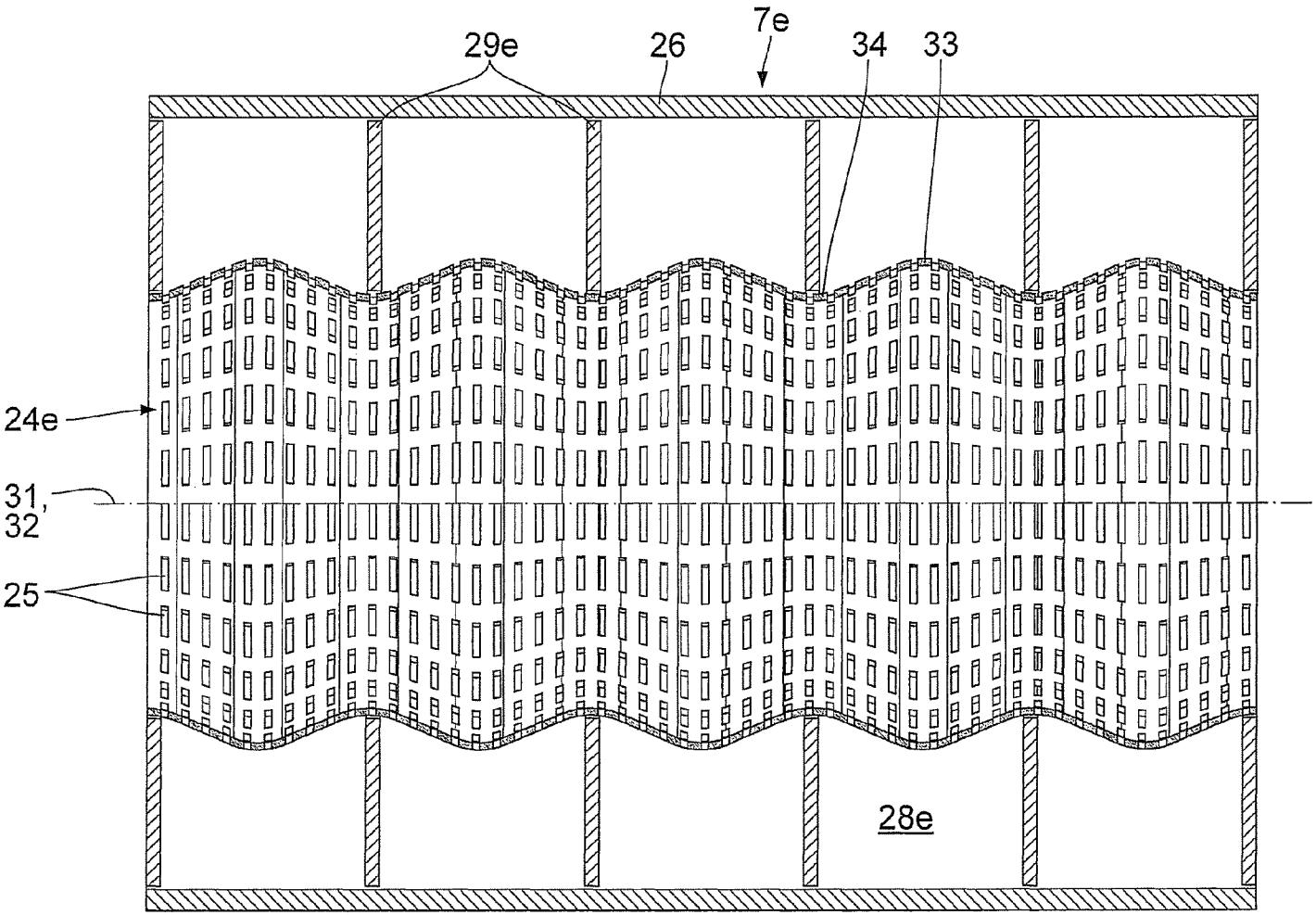
FIG. 9 shows a longitudinal cross section of a first silencer device according to a sixth embodiment.

The silencer device 7*e* shown in FIG. 9 according to a sixth embodiment has a tubular gas guiding element 24*e*, the wall of which is designed to be wave-like. It thus has wave peaks 33 and wave troughs 34, which are arranged to alternate one another. The wave peaks 33 or wave troughs 34 are arranged behind one another in the direction of the longitudinal middle axis 31.

Figure 10:
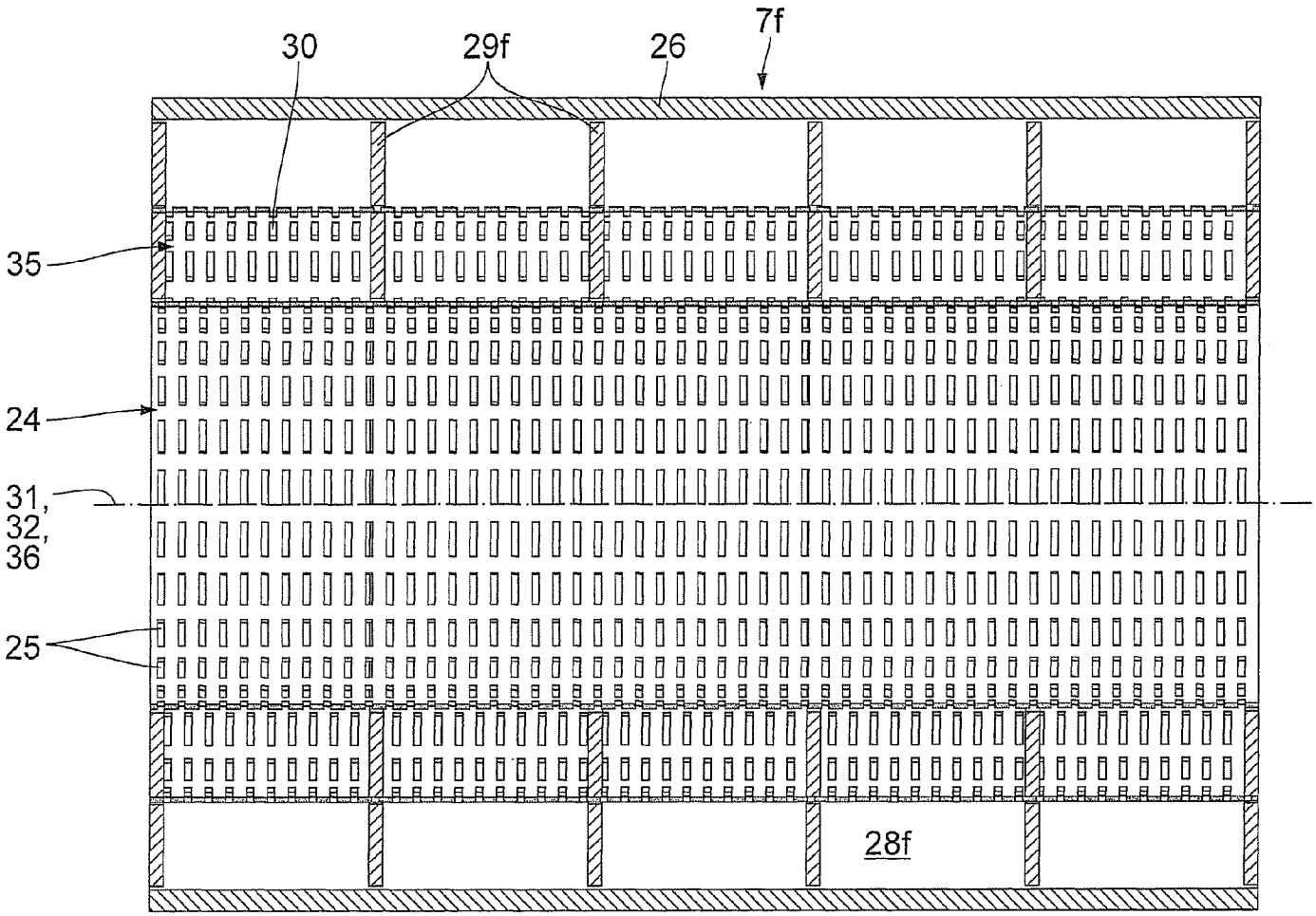
FIG. 10 shows a longitudinal cross section of a first silencer device according to a seventh embodiment.

In the silencer device 7*f* according to FIG. 10 according to a seventh embodiment the tubular gas guiding element 24 runs in an additional silencer element 35, which is also designed to be tubular and has a circular ring-like cross section. It has a longitudinal middle axis 36, which coincides with the longitudinal middle axis 31 or 32. The additional silencer element 35 is designed principally like the gas guiding element 24. It also has a plurality of silencer openings 25.

It should be noted that alternatively combinations of the individual silencer devices 7 to 7*f* are possible. This relates in particular to the arrangement of the screen walls 29 and the design or position of the gas guiding element 24, 24*d*, 24*e*.

The silencer devices can be used in different blowers, such as axial, radial or side channel blowers.

The invention claimed is:

1. Blower arrangement, in particular a side channel blower arrangement, for gas with a blower, comprising:

a blower housing, at least one gas inlet opening formed in the blower housing, at least one gas outlet opening formed in the blower housing, which gas outlet opening is in flow connection with the at least one gas inlet opening, and at least one rotary-driven blower wheel arranged in the blower housing for conveying the gas from the at least one gas inlet opening to the at least one gas outlet opening, and at least one silencer device with at least one gas guiding element for guiding the gas, said gas guiding element arranged in a housing and delimits outwardly a gas flow channel, wherein the at least one gas guiding element comprises a plurality of silencer openings, wherein the gas guiding element is designed as a gas guiding pipe, wherein the gas guiding pipe varies its cross section along its longitudinal extension, and wherein the gas guiding pipe has a wall, which is designed to be wave-like along the longitudinal extension of the gas guiding pipe, and a plurality of silencer chambers, which are in flow connection with the silencer openings, the plurality of chambers are arranged along the longitudinal extension of the at least one gas guiding element, outward of the gas guiding element, and inward of the housing;

are each separated from one another by a plurality of walls arranged along the longitudinal extension of the gas guiding element, each of said plurality of chambers is delimited by an adjacent pair of said plurality of walls.

2. Blower arrangement according to claim 1, wherein the plurality of walls are screen walls.

3. Blower arrangement according to claim 2, wherein the screen walls are spaced apart from one another at uneven distances.

4. Blower arrangement according to claim 1, wherein adjacent the gas guiding element at least one additional silencer element comprising a plurality of silencer openings is arranged.

5. Blower arrangement according to claim 1, wherein the silencer device connects to the gas outlet opening.

6. Blower arrangement according to claim 1, wherein the housing is a silencer housing and is designed to be tubular, wherein the gas guiding element and the silencer housing are arranged to be concentric to one another.

7. Blower arrangement according to claim 6, wherein the gas guiding element, an additional silencer tube and the silencer housing are arranged to be concentric to one another.

8. Blower arrangement according to claim 1, wherein the housing is a silencer housing and is designed to he tubular, wherein the gas guiding element and the silencer housing are arranged to be eccentric in relation to one another.

9. Blower arrangement according to claim 1 wherein at least one gas guiding element is arranged in the blower housing and delimits a gas flow channel at least in sections between the gas inlet opening and the gas outlet opening.

* * * * *